United States Patent [19]

Kaibara et al.

[11] Patent Number: 4,524,914

[45] Date of Patent: Jun. 25, 1985

[54] THROTTLING PINTLE-TYPE FUEL INJECTION NOZZLE HAVING AN IMPROVED INITIAL INJECTION CHARACTERISTIC

[75] Inventors: Nobuhiro Kaibara; Toshio Ida; Shinji Okuda; Takayuki Motohashi, all of Higashimatsuyama, Japan

[73] Assignee: Diesel Kiki Co., Ltd., Tokyo, Japan

[21] Appl. No.: 566,498

[22] Filed: Dec. 29, 1983

[30] Foreign Application Priority Data

Jan. 27, 1983 [JP] Japan ..... 58-10176[U]

[51] Int. Cl.[3] ..... B05B 1/32; F02M 61/06

[52] U.S. Cl. ..... 239/452; 239/459; 239/533.12

[58] Field of Search ..... 239/533.3–533.12, 239/452, 456, 459

[56] References Cited

U.S. PATENT DOCUMENTS

| | | | |
|---|---|---|---|
| 3,035,780 | 5/1962 | Péras | 239/533.12 |
| 3,830,433 | 8/1974 | Miyake et al. | 239/533.5 |
| 4,213,568 | 7/1980 | Hofmann | 239/533.4 |

FOREIGN PATENT DOCUMENTS

| | | | |
|---|---|---|---|
| 57-49063 | 3/1982 | Japan . | |
| 2083134 | 3/1982 | United Kingdom | 239/533.3 |
| 2104150 | 3/1983 | United Kingdom | 239/533.3 |

*Primary Examiner*—Andres Kashnikow
*Assistant Examiner*—Michael J. Forman
*Attorney, Agent, or Firm*—Frishauf, Holtz, Goodman & Woodward

[57] ABSTRACT

A pintle on the tip of the nozzle needle, which is disposed to be fitted through the nozzle hole of the nozzle body opening in a combustion chamber of an engine, has a conical portion. The conical portion extends along substantially the whole length of the nozzle hole when the nozzle needle has its seating portion seated on a valve seating portion of the nozzle body, and has a depth gradually decreasing toward the combustion chamber to define between itself and the nozzle needle an annular gap gradually expanding toward the combustion chamber. A portion of the pintle, which is substantially on a level with an end of the nozzle hole remote from the combustion chamber when the seating portion of the nozzle needle is in its seated position, has a diameter substantially equal to the inner diameter of the above end of the nozzle hole.

3 Claims, 7 Drawing Figures

THROTTLING PINTLE-TYPE FUEL INJECTION NOZZLE HAVING AN IMPROVED INITIAL INJECTION CHARACTERISTIC

BACKGROUND OF THE INVENTION

This invention relates to a throttling pintle-type fuel injection nozzle for internal combustion engines, and more particularly to improvements in the pintle of the fuel injection nozzle.

Throttling pintle-type fuel injection nozzles are generally used in internal combustion engines equipped with precombustion chambers or ones equipped with swirl chambers and have a reduced injection rate at the initial stage of injection so as to obtain smooth starting of combustion and thereby attain soft combustion within the combustion chambers of the engine.

A typical throttling pintle-type fuel injection nozzle comprises a nozzle body fixed to the nozzle holder of a fuel injection valve, and a nozzle needle slidably mounted within the nozzle body and liftable by the force of pressurized fuel. The nozzle needle has a seating portion disposed for seating on a valve seating portion of the nozzle body, and a cylindrical pintle formed on tip of the seating portion and slidably fitted through a nozzle hole formed in the nozzle hole.

The pintle and the nozzle hole cooperate to define therebetween a small annular gap for producing a fuel-throttling effect such that the fuel injection quantity is restrained at the start of lifting of the nozzle needle, i.e. at the beginning of fuel injection, thereby preventing a sudden increase in the pressure within the combustion chamber of the engine and accordingly preventing knocking of the engine.

However, such throttling pintle-type fuel injection nozzle has the disadvantage that hot combustion gases are intruded into the above annular gap between the pintle and the nozzle hole to cause decomposition of a film of fuel stuck on the inner peripheral surface of the nozzle hole to form carbon deposits. After a long period of use of the fuel injection nozzle, increased carbon deposits on the inner peripheral surface of the nozzle hole will almost fully clog the annular gap between the pintle and the nozzle hole, to reduce the throttling effect of the annular gap, causing knocking of the engine as well as deterioration of the emission characteristics of the engine due to incomplete combustion. If a measure is taken to restrain a rise in the temperature in the vicinity of the nozzle hole so as to minimize decomposition of the fuel film, sulfur contained in the fuel forms sulfuric acid which causes corrosion of a portion of the end wall surface of the nozzle body in the vicinity of the nozzle hole opening therein.

To overcome the above disadvantages, a fuel injection nozzle has been proposed in Japanese Provisional Patent Publication No. 57-49063. According to this proposed fuel injection nozzle, the nozzle hole has a conical shape with its inner diameter gradually decreasing toward its end opening in the combustion chamber so as to prevent intrusion of hot combustion gases into the annular gap between the nozzle hole and the pintle of the nozzle needle. The clearance between the nozzle needle and the above end of the nozzle hole assumes a very small value from 0 to 0.005 mm when the nozzle is in its closed position. However, it is very difficult to bore such a nozzle hole which has a very small diameter of the order of 1 mm, in such a manner that the inner diameter gradually decreases toward the open end, inviting low productivity as well as an increased manufacturing cost.

SUMMARY OF THE INVENTION

It is an object of the invention to provide a throttling pintle-type fuel injection nozzle which can maintain a required throttling effect produced by the cooperative action of the nozzle hole of the nozzle body and the pintle of the nozzle needle and thus maintain a required initial injection characteristic for a long period of use, thereby preventing knocking and deterioration of the emission characteristics of the engine.

It is a further object of the invention to provide a throttling pintle-type fuel injection nozzle which is easy to machine, thereby being high in productivity and low in manufacturing cost.

It is another object of the invention to provide a throttling pintle-type fuel injection nozzle which is capable of maintaining a required fuel injection quantity and also preventing seizure of the nozzle body and the nozzle needle, even when some amount of carbon is deposited on the inner peripheral wall of the nozzle hole. It is a further object of the invention to provide a throttling pintle-type fuel injection nozzle which can positively prevent intrusion of hot combustion gases into the internal space defined by the valve seating portion of the nozzle body, to thereby avoid formation of carbon deposits in the vicinity of the valve seating portion.

The present invention provides a throttling pintle-type fuel injection nozzle for use in a fuel injection valve having a nozzle holder and mounted in an internal combustion engine having at least one combustion chamber. The fuel injection nozzle comprises a nozzle body fixed to the nozzle holder of the fuel injection valve, and a nozzle needle mounted within the nozzle body and having a guide portion slidably fitted in an axial hole formed in the nozzle body, a seating portion formed adjacent the guide portion and seatable on a valve seating portion formed in the nozzle body, and a pintle formed adjacent the seating portion and disposed to be fitted through a nozzle hole formed in the nozzle body. The pintle of the nozzle needle has a conical portion disposed such that its one end is substantially on a level with an end of the nozzle hole remote from the combustion chamber of the engine, and its other end with the other end of the nozzle hole opening in the combustion chamber, respectively, when the seating portion of the nozzle needle is seated on the valve seating portion of the nozzle body. The conical portion of the pintle has a depth gradually decreasing from the above one end thereof to the other end thereof.

A portion of the pintle of the nozzle needle which is substantially on a level with the above one end of the nozzle hole when the seating portion of the nozzle needle is in the above seated position has a diameter substantially equal to the inner diameter of the above one end of the nozzle hole, whereby an annular gap is defined between the pintle and the nozzle hole, which gradually expands from the above one end of the nozzle hole to the other end thereof when the seating portion of the nozzle needle is in its seated position.

The above and other objects, features and advantages of the invention will be more apparent from the ensuing detailed description taken in conjunction with the accompanying drawings.

DETAILED DESCRIPTION

Figure 1:
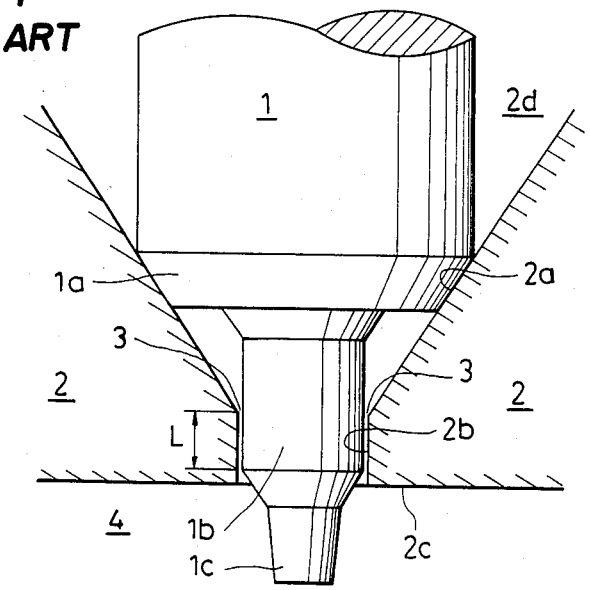
FIG. 1 PRIOR ART
FIG. 1 is a fragmentary longitudinal sectional view of a conventional throttling pintle-type fuel injection nozzle, showing, by way of example, the arrangement of the nozzle hole, the pintle and their peripheral parts.

Referring to FIG. 1, there is illustrated a conventional throttling pintle-type fuel injection nozzle. The nozzle is mounted on a fuel injection valve, not shown, provided in an internal combustion engine equipped with precombustion chambers or swirl chambers. An end portion of the nozzle needle 1 closer to a precombustion chamber or a swirl chamber (hereinafter merely called "the combustion chamber") designated by numeral 4, of the engine is formed with a conical seating portion 1*a*, a pintle 1*b* in the form of a cylinder, and a tip 1*c* with a smaller diameter than the pintle 1*b*, successively arranged in the mentioned order. In the illustrated position, the seating portion 1*a* of the nozzle needle 1 is seated on a valve seating portion 2*a* of the nozzle body 2 in tight contact therewith to close the nozzle, while the pintle 1*b* is fitted through a nozzle hole 2*b* formed in an end wall 2*c* of the nozzle body 2 facing the combustion chamber 4. In this closed position, the pintle 1*b* cooperates with the nozzle hole 2*b* to define therebetween an annular gap 3 usually having a clearance of 0.010–0.025 mm serving as a fuel passage. A pressure chamber 2*d* is defined within the nozzle body 2 which is supplied with pressurized fuel from a fuel injection pump, not shown, for acting upon a pressure stage (pressure-applying portion) of the nozzle needle 1 to cause lifting of the nozzle needle 1. During a throttling stroke of the nozzle needle 1 wherein the pintle 1*b* moves along the nozzle hole 2*b* through a distance L, i.e. through an initial injection lift, the fuel injection quantity is restricted by the small gap 3 between the pintle 1*b* and the nozzle hole 2*b* so as to obtain smooth and soft combustion within the combustion chamber 4, and then during the succeeding main injection lift stroke of the nozzle needle 1, a required amount of fuel is injected, to thereby prevent knocking of the engine.

According to the illustrated conventional fuel injection nozzle, however, during the returning or non-injection stroke of the nozzle needle 1, hot combustion gases in the combustion chamber 4 are introduced into the gap 3 and cause decomposition of a film of fuel formed on the inner peripheral surface of the nozzle hole 2*b* to form carbon deposits. And after a long period of use of the nozzle, piled carbon deposits will almost clog the gap 3 which should serve as a fuel passage, which reduces or extinguish the throttling effect, resulting in inconveniences as hereinbefore stated.

Figure 2:
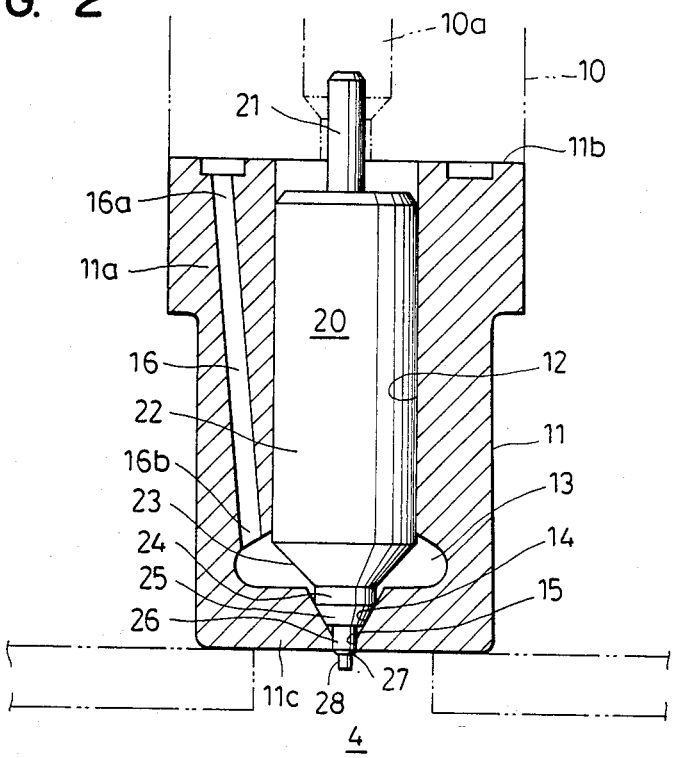
FIG. 2 is a longitudinal sectional view of a throttling pintle-type fuel injection nozzle according to an embodiment of the present invention.

An embodiment of the present invention will now be described with reference to FIGS. 2 and 3.

A nozzle body 11 is supportedly fixed to one side of a nozzle holder 10 forming part of a fuel injection valve, not shown, which is mounted in an internal combustion engine equipped with precombustion chambers or swirl chambers (hereinafter merely called "the combustion chamber"). The interior of the nozzle body 11 is formed along its axis with a cylindrical guide hole 12 in which a guide portion 22 of a nozzle needle 20 is slidably fitted, a pressure chamber 13 which is swelled radially outwardly of the guide hole 12, a valve seating portion 14 having a conical inner peripheral surface, and a nozzle hole 15 having a cylindrical configuration, which are successively arranged in the mentioned order. The nozzle hole 15 is formed through an end wall 11*c* of the nozzle body 11 facing the combustion chamber 4. The peripheral wall 11*a* of the nozzle body 11 is formed therein with an axially extending fuel passage 16 which has its opposite ends 16*a*, 16*b* opening, respectively, in an end face 11*b* of the nozzle body 11 facing the nozzle holder 10 and in the pressure chamber 13. The end 16*a* of the fuel passage 16 communicates through the interior of the nozzle holder 10 with a fuel injection pump, not shown, to guide pressurized fuel delivered from the pump into the pressure chamber 13.

On the other hand, the nozzle needle 20 is formed of a journal 21 fitted in an axial hole 10*a* formed in the nozzle holder 10 and coupled to a spring seat, not shown, for a pressure spring, not shown, the aforesaid guide portion 22 slidably fitted in the guide hole 12 of the nozzle body 11, a conical pressure stage (pressure-applying portion) 23, a cylindrical portion 24, a conical seating portion 25, a pintle 26 fitted through the nozzle hole 15 of the nozzle body 11, a conical stepped shoulder 27, and a slightly tapered tip portion 28 with a diameter slightly smaller than that of the pintle 26. These component portions of the nozzle needle 20 are successively arranged in the mentioned order starting from the nozzle holder side. The pintle 26 of the nozzle needle 20 is so disposed to extend through the nozzle hole 15 of the nozzle body 11 along the substantially whole length of the latter when the nozzle is in its closed position wherein the seating portion 25 of the nozzle needle 20 is seated on the valve seating portion 14 of the nozzle body 11. According to the embodiment of FIGS. 2 and 3, the pintle 26 comprises a conical portion 26*a* disposed to be fitted through the nozzle hole 15, and a cylindrical portion 26*b* connecting the conical portion 26*a* with the seating portion 25. The length L2 of the conical portion 26*a* is slightly larger than the length L1 of the nozzle hole 15. The diameter d2 of the cylindrical portion 26*b* is slightly larger than the diameter d1 of the nozzle hole 15, and the diameter d3 of a portion of the conical portion 26*a* in the vicinity of its boundary 26*c* with the cylindrical portion 26*b* is substantially equal to the diameter d1 of the nozzle hole 15. The boundary 26*d* between the pintle 25 and the conical stepped shoulder 27 is disposed to lie on substantially the same plane with an open end 15*a* of the nozzle hole 15 opening in the combustion chamber 4 when the nozzle is in its closed position.

Since the length L2 of the conical portion 26*a* is larger than the length L1 of the nozzle hole 15 as noted above, the end 26c of the conical portion 26a is located slightly remoter from the combustion chamber 4 than the open end 15b of the nozzle hole 15 closer to the seating portion 14 is, so that the same open end 15b of the nozzle hole 15 is blocked by an outer peripheral surface 26a' of the conical portion 26a near the end 26c thereof, when the nozzle is in its closed position.

It has been ascertained by the inventors that the angle $\theta$ of the outer peripheral surface of the conical portion 26a to the inner peripheral surface of the nozzle hole 15 should preferably be set at a value within a range from 1°30' to 4°00'.

Figure 3:
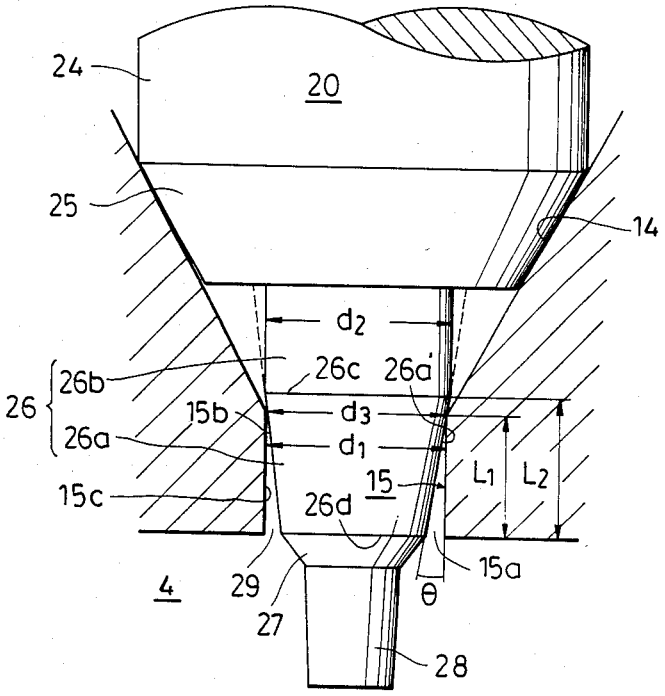
FIG. 3 is an enlarged fragmentary longitudinal sectional view of the nozzle hole, pintle and their peripheral parts of the nozzle of FIG. 2.

The whole portion of the pintle 26 may be conically shaped as indicated by the broken line in FIG. 3, while omitting the cylindrical portion 26b.

Since at least part of the pintle 26 of the nozzle needle 20 which is disposed to be fitted through the nozzle hole 15 of the nozzle body 11 is conically shaped as noted above, the open end 15b of the nozzle needle 15 is substantially closed by the conical portion 26a when the nozzle is in its closed position wherein the nozzle needle is in its seated position. In this nozzle-closed position, an annular gap 29 is defined between the outer peripheral surface 26a' of the conical portion 26a and the inner peripheral surface 15c of the nozzle hole 15, which gradually expands toward the combustion chamber 4.

The operation of the throttling pintle-type fuel injection nozzle constructed as above is as follows: When the nozzle needle 20 is downwardly moved as viewed in FIGS. 2 and 3 by the force of a pressure spring, not shown, which urges the nozzle needle 20 in a direction away from the nozzle holder 10 to cause its seating portion 25 to be seated on the valve seating portion 14 of the nozzle body 11, that is, to close the nozzle, fuel injection is interrupted. On this occasion, the open end 15b of the nozzle hole 15 closer to the seating portion 14 is substantially closed by the outer peripheral surface 26a' of the conical portion 26a of the pintle 26. This closure of the nozzle hole 15 prevents intrusion of hot combustion gases from the combustion chamber 4 into the internal space defined by the valve seating portion 14 through the gap 29 between the nozzle hole 15 and the pintle 26, thereby preventing decomposition of a film of fuel deposited on the inner peripheral surface of the nozzle seating portion 14.

Then, when pressurized fuel is supplied from the fuel injection pump into the pressure chamber 13, the fuel pressure acts upon the pressure stage 23 of the nozzle needle 20 to cause the nozzle needle 20 to be lifted against the force of the pressure spring, the seating portion 25 of the nozzle needle 20 is detached from the valve seating portion 14 of the nozzle body 11, and at the same time an annular gap is formed between the outer peripheral surface 26a' of the conical portion 26a of the pintle 26 and the inner peripheral surface 15c of the nozzle hole 15 so that the pressurized fuel is injected through the nozzle hole 15 into the combustion chamber 4.

Figure 5:
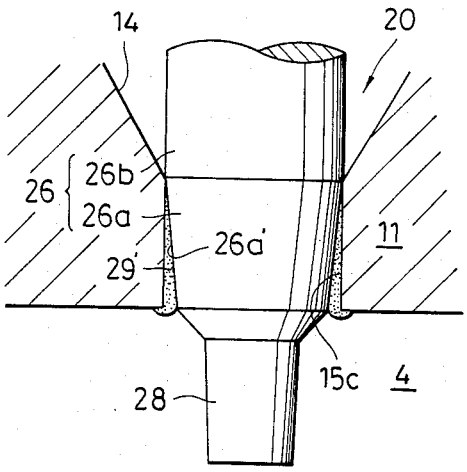
FIG. 5 is a fragmentary longitudinal sectional view of the nozzle of FIG. 2, showing carbon deposits on the inner wall of the nozzle hole, with the nozzle in a closed position.
Figure 6:
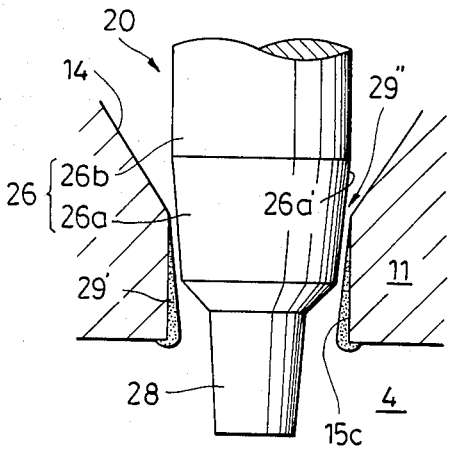
FIG. 6 is a view similar to FIG. 5, wherein the nozzle needle is in a lifted position.

After a long period of use of the nozzle, a film of fuel stuck to the inner peripheral surface 15c of the nozzle hole 15 is decomposed into carbon by hot combustion gases, and the carbon is deposited on the same surface 15c. That is, as shown in FIG. 5, the carbon designated by numeral 29' accumulates in the gap 29 between the conical portion 26a of the pintle 26 and the nozzle hole 15. However, according to the invention, as shown in FIG. 6, as the nozzle needle 20 is lifted and accordingly the conical portion 26a moves away from the nozzle hole 15, the conical portion 26a ensures formation of an annular gap 29'' defined between the outer peripheral surface 26a' of the conical portion 26a and the opposed inner peripheral surface of the accummulated carbon 29', even if carbon is present in the gap 29 between the conical portion 26a and the nozzle hole 15. The annular gap 29'' defined as above serves as a fuel passage for enabling initial injection when the nozzle needle 20 is lifted. On the other hand, during both the initial injection stroke and the following main injection stroke, hot combustion gases are hindered from being guided to the seating portion 14 of the nozzle body 11 due to a jet of fuel being injected through the nozzle hole 15, but removal of the carbon piled on the inner peripheral surface 15c of the nozzle hole 15 is carried out due to a jet of fuel being injected through the nozzle hole 15 and reciprocating motion of the pintle 26 of the nozzle needle 20, thus restraining deposition of carbon on the inner peripheral surface of the nozzle hole 15.

Figure 7:
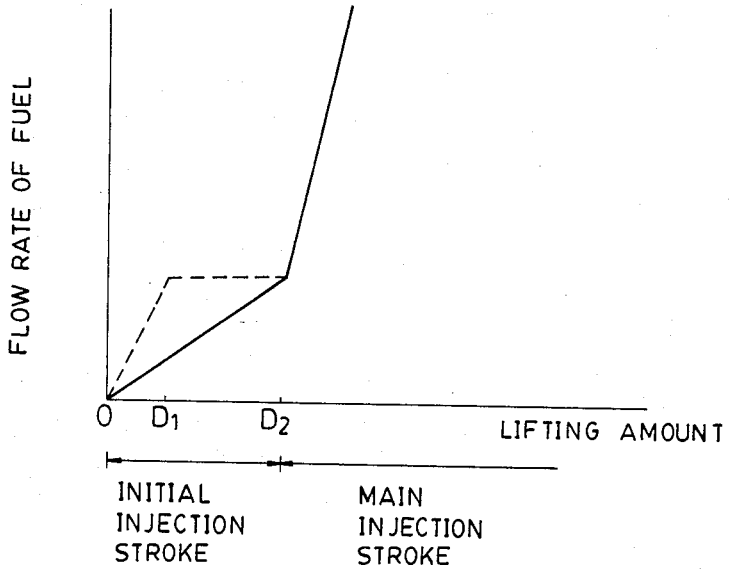
FIG. 7 is a graph showing the injection rate lifting amount characteristics of the nozzles of FIG. 1 and FIG. 2.

FIG. 7 shows the flow rates of fuel being injected through the nozzle hole of the conventional nozzle shown in FIG. 1 and the nozzle shown in FIGS. 2 through 6 according to the present invention. According to the conventional nozzle, as indicated by the broken line in FIG. 7, while the nozzle needle 1 is lifting through a former half 0–D1 of the initial injection stroke wherein the gap defined between the seating portion 1a of the nozzle needle and the valve seating portion 2a of the nozzle body 2 produces a throttling effect, the flow rate of fuel through the nozzle hole increases in proportion to an increase in the lifting amount of the nozzle needle. Then, while the nozzle needle 1 is lifting through a latter half D1–D2 of the initial injection stroke wherein the lifting amount increases from D1 to a value D2 at which the pintle 1b of the nozzle needle 1 is completely disengaged from the nozzle hole 2b, the flow rate is kept at a substantially constant value due to a throttling effect produced by the fuel passage 3 between the pintle 1b and the nozzle hole 2b. After the lifting amount has exceeded the value D2, the flow rate of fuel through the nozzle hole increases at a suddenly increased rate to effect a main injection. During the initial injection stroke, the flow rate of fuel through the nozzle hole is reduced by an amount of carbon deposited on the inner peripheral surface of the nozzle hole 2b.

On the other hand, according to the nozzle of the present invention, as indicated by the solid line in FIG. 7, while the nozzle needle 20 is lifting through the whole initial injection stroke 0–D2 wherein the conical portion 26a is moving within the nozzle hole 15 so that the gap 29 between the conical portion 26a and the nozzle hole 15 produces a throttling effect, the flow rate of fuel through the nozzle hole 15 slowly linearly increases with an increase in the lifting amount to effect a fuel-throttling or initial injection. After the conical portion 26a has completely left the nozzle hole 15 with further lifting of the nozzle needle 20, the flow rate of fuel through the nozzle hole increases at a suddenly increased rate to effect a main injection.

Figure 4:
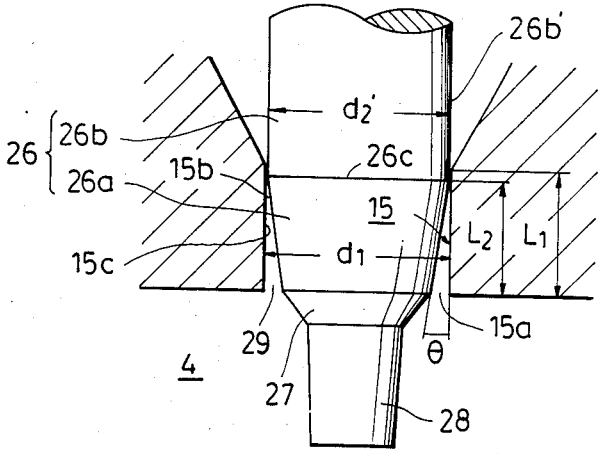
FIG. 4 is a view similar to FIG. 3, showing a variation of the pintle in FIG. 3.

FIG. 4 shows a variation of the nozzle needle of the nozzle according to the invention. According to this variation, the length L2 of the conical portion 26a is set at a value slightly smaller than the length L1 of the nozzle hole 15. The diameter d2' of the cylindrical portion 26b adjacent the conical portion 26a is set at a value substantially equal to the diameter d1 of the nozzle hole 15. With this setting, when the nozzle is in its closed position, the end 26*c* of the conical portion 26*a* is located slightly closer to the combustion chamber 4 than the open end 15*b* of the nozzle hole 15 is so that the same open end 15*b* is blocked by the outer peripheral surface 26*b'* of the cylindrical portion 26*b*. Even this variation can provide similar results as those obtained with the embodiment of FIGS. 2 and 3.

As described in the foregoing, the fuel injection nozzles according to the present invention are capable of effecting a fuel-throttling injection in a more gentle manner than conventional fuel injection nozzles. This gentle injection makes slower an increase in the pressure within the combustion chamber, thereby effectively preventing knocking of the engine.

What is claimed is:

1. A throttling pintle-type fuel injection nozzle for use in a fuel injection valve having a nozzle holder and mounted in an internal combustion engine having at least one combustion chamber, said fuel injection nozzle comprising:

a nozzle body fixed to said nozzle holder of said fuel injection valve, said nozzle having an axial hole, a valve seating portion and a nozzle hole formed therein and succesively arranged in the order mentioned along an axis thereof, said nozzle hole having a cylindrical configuration and having one end remote from said combustion chamber of said engine and another end opening into said combustion chamber, said nozzle hole having a substantially constant diameter along the whole length thereof;

a nozzle needle mounted within said nozzle body, said nozzle needle having a guide portion slidably fitted in said axial hole of said nozzle body, a seating portion formed adjacent said guide portion and seatable on said valve seating portion of said nozzle body, a pressure-applying portion located between said guide portion and said seating portion, and a pintle formed adjacent said seating portion and disposed to be fitted through said nozzle hole of nozzle body;

said axial hole of said nozzle body having a guide hole in which said guide portion of said nozzle needle is slidably fitted, and a pressure chamber formed adjacent one end of said guide hole closer to said combustion chamber and disposed to be supplied with pressurized fuel, said pressure chamber being swelled radially outwardly of said guide hole and accommodating at least part of said pressure-applying portion of said nozzle needle;

said pintle of said nozzle needle having a conical portion having two ends, said conical portion being disposed such that one end of said conical portion is located slightly remoter from said combustion chamber than is said one end of said nozzle hole, and another end of said conical portion is substantially on a level with said another end of said nozzle hole opening into said combustion chamber when said seating portion of said nozzle is in a position seated on said valve seating portion of said nozzle body, said conical portion of said pintle having a diameter gradually decreasing from said one end thereof to said another end thereof;

said conical portion of said pintle having an outer peripheral surface and said conical portion having a portion disposed to on a level with said one end of said nozzle hole when said seating portion is in said seated position, said portion of said conical portion having a diameter equal to the inner diameter of said one end of said nozzle hole;

whereby when said seating portion of said nozzle needle is in said seated position, said pintle and said nozzle hole define therebetween an annular gap gradually expanding from said one end of nozzle hole to said another end thereof, with said one end of said nozzle hole being positiviely closed by said outer peripheral surface of said conical portion of said pintle.

2. A throttling pintle-type fuel injection nozzle as claimed in claim 1, wherein said pintle has a cylindrical portion extending from said one end of said conical portion thereof in a direction away from said combustion chamber.

3. A throttling pintle-type fuel injection nozzle as claimed in claim 1, wherein said nozzle hole has an inner peripheral surface and said outer peripheral surface of said conical portion of said pintle is directed at an angle within a range from 1°30' to 4°00' with respect to said inner perpheral surface of said nozzle hole.

* * * * *